US008529296B2

(12) United States Patent
Lee et al.

(10) Patent No.: US 8,529,296 B2
(45) Date of Patent: Sep. 10, 2013

(54) CONNECTOR

(75) Inventors: Yi-Bin Lee, Taoyuan Hsien (TW); Yan-Jun Liu, Taoyuan Hsien (TW); Wang-Jun He, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 97 days.

(21) Appl. No.: 12/943,608

(22) Filed: Nov. 10, 2010

(65) Prior Publication Data

US 2011/0111620 A1 May 12, 2011

(30) Foreign Application Priority Data

Nov. 12, 2009 (TW) ..... 98138389 A

(51) Int. Cl.
*H01R 13/66* (2006.01)

(52) U.S. Cl.
USPC ..... 439/620.07; 439/487

(58) Field of Classification Search
USPC ..... 439/487, 620
See application file for complete search history.

(56) References Cited

U.S. PATENT DOCUMENTS

| | | | | |
|---|---|---|---|---|
| 6,086,422 | A * | 7/2000 | Glynn | 439/620.07 |
| 6,328,595 | B1 * | 12/2001 | Chang | 439/490 |
| 6,986,684 | B1 * | 1/2006 | Lien | 439/620.07 |
| 7,040,927 | B1 * | 5/2006 | Liu | 439/620.2 |
| 7,044,779 | B1 * | 5/2006 | Liu | 439/541.5 |
| 7,524,206 | B2 * | 4/2009 | Gutierrez et al. | 439/607.01 |
| 7,547,217 | B1 * | 6/2009 | Lin | 439/76.1 |
| 8,147,278 | B2 * | 4/2012 | Renteria et al. | 439/676 |
| 2009/0318015 | A1 * | 12/2009 | Slepov | 439/490 |

* cited by examiner

*Primary Examiner* — Truc Nguyen
(74) *Attorney, Agent, or Firm* — Muncy, Geissler, Olds & Lowe, PLLC

(57) ABSTRACT

A connector is provided, including a housing, a base, a circuit board, a receptacle, a plurality of first terminals, and a filtering element. The base is disposed in the housing and forms a recess. The circuit board is disposed at a rear side of the base. The circuit board is coupled to the recess of the base to form an accommodating space. The receptacle is formed on the housing to receive an external plug. A plurality of first terminals are disposed on the base to electrically connect to the external plug. The filtering element is disposed in the accommodating space and is electrically connected to the circuit board.

18 Claims, 7 Drawing Sheets

CONNECTOR

CROSS REFERENCE TO RELATED APPLICATIONS

This application claims priority of Taiwan Patent Application No. 098138389, filed on Nov. 12, 2009, the entirety of which is incorporated by reference herein.

BACKGROUND OF THE INVENTION

1. Field of the Invention

This application relates in general to a connector having a filtering element which is easy to assembly and improves product reliability.

2. Description of the Related Art

Conventional RJ45 connectors may be adversely influenced by noise generated from external power sources through cables. Filter circuits are usually provided to suppress the noise. Traditional filter circuits may comprise a plurality of coils connected to a circuit board by soldering. As shown in FIG. 1, a plurality of terminals 12 are disposed in front of a base 11 for electrical connection to an external plug. A plurality of coils 13 are disposed on a circuit board 14, wherein enameled wires 131 of the coils 13 are electrically connected to the circuit board 14 by soldering. However, the enameled wires 131 may be broken or shorted during the soldering process. Additionally, since the soldering process of the enameled wires 131 is complex, assembly time of the connector may be adversely increased.

BRIEF SUMMARY OF INVENTION

An object of the application is to provide a connector having a filtering element which is easy to assembly and improves product reliability. The connector includes a housing, a base, a circuit board, a receptacle, a plurality of first terminals, and a filtering element. The base is disposed in the housing and has a recess. The circuit board is disposed at a rear side of the base. The circuit board covers the recess of the base to form an accommodating space. The receptacle is formed in the housing to receive an external plug. A plurality of first terminals are disposed on the base to electrically connect to the external plug. The filtering element is disposed in the accommodating space and is electrically connected to the circuit board.

The base includes a first plate, a second plate, and a connection portion connecting the first plate with the second plate. The first and second plates are substantially parallel to each other and perpendicular to the connection portion.

The first plate has a plurality of first slots for receiving a plurality of first terminals. The first terminal has a deflecting portion and a bending portion. The deflecting portion is deflected laterally and the bending portion is bent downwardly. The first plate forms a plurality of first slots disposed corresponding to the first terminals. The first slot has a deflecting section with the deflecting portion of the first terminal engaged therein. Additionally, the first terminal further has a nub to securely engage the first terminal in the first slot.

The first plate is disposed above the receptacle. An end of the first terminal is connected to the circuit board, and the other end of the first terminal is bent downwardly to electrically connect with the external plug through the receptacle. The recess is formed by the connection portion and the first and second plates. Specifically, the recess forms two slopes, respectively located between the first plate and the connection portion and between the second plate and the connection portion.

The connector further includes a plurality of second terminals electrically connected to the first terminals via the circuit board. The base has a plurality of second slots for receiving the second terminals. The second terminal has a hook portion hooked onto the second plate and connected to the circuit board via an end thereof. The circuit board includes a plurality of holes for fixing ends of the hook portions.

The connection portion has a plurality of slits disposed corresponding to the second slots. The hook portion of the second terminal is disposed through the slit during assembly to securely hook onto the second plate.

The filtering element includes a main body and a plurality of leads electrically connected to the circuit board. An inner surface of the recess is configured to correspond to the shape of the main body of the filtering element, wherein the slopes of the recess are configured corresponding to the slopes of the main body. The main body includes a plurality of coils electrically connected to the leads. The main body of the filtering element may be formed by injection molding with the coils embedded therein. The leads may be integrated with a lead frame. The circuit board includes a plurality of holes for fixing the leads of the filtering element or the first terminals. An embodiment of the filtering element may be a transformer.

The connector may further include at least an indicator, a metal shield, an insulator, and at least an electronic component. The indicator is disposed on a bottom side of the housing, and the metal shield covers the housing. The insulator is disposed at a rear side of the circuit board, opposite to the filtering element. The electronic component is disposed on the circuit board and located between the insulator and the circuit board.

The application further provides a connector comprising a housing, a base, a circuit board, a receptacle, a plurality of first terminals, and a filtering element. The base is disposed in the housing and includes a plurality of protrusions. The circuit board is horizontally disposed on the base and contacts the protrusions. The protrusions abut against the circuit board to form a space between the base and the circuit board. The receptacle is formed on the housing to receive an external plug. The first terminals are disposed on the base to electrically connect to the external plug via the receptacle. The filtering element is disposed on the circuit board and is electrically connected to the circuit board.

The base includes a first plate and a second plate, both of which are connected to each other in parallel, wherein the first plate is disposed below the receptacle. The first plate has a plurality of first slots for receiving the first terminals. The first terminal has a first bending portion bent upwardly to electrically connect to the external plug via the receptacle. The first terminal further has a second bending portion. The second bending portion is bent upwardly and extended through a through hole between the first plate and the second plate. Additionally, an end of the second bending portion protrudes upon the second plate and electrically connects to the circuit board. An embodiment of the connector further includes at least a block to fix the indicator to the housing.

The base further includes at least one positioning member. The circuit board has at least one positioning hole disposed corresponding to the positioning member.

The connector may further include a plurality of second terminals electrically connected to the first terminals via the circuit board. The second terminal has a transition portion which is bent upwardly and extended through the base. Specifically, the second terminals include a plurality of first and second leads, wherein the transition portions of the second leads are shorter than those of the first leads. The base includes a plurality of second slots for receiving the transition portions of the second terminals. The base further includes a plurality of openings disposed corresponding to the holes of the circuit board. The second terminals pass through the openings of the base and are fixed in the holes of the circuit board.

The connector may further include at least an indicator, a metal shield, and at least an electronic component. The indicator may be fixed to a top side of the housing by at least a block. The metal shield encompasses the housing, and the electronic component is disposed on a side of the circuit board, opposite to the filtering element, between the base and the circuit board. The base is substantially made of insulating material. In some embodiments, the base may be formed as a monolithic piece or assembled by several individual parts.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
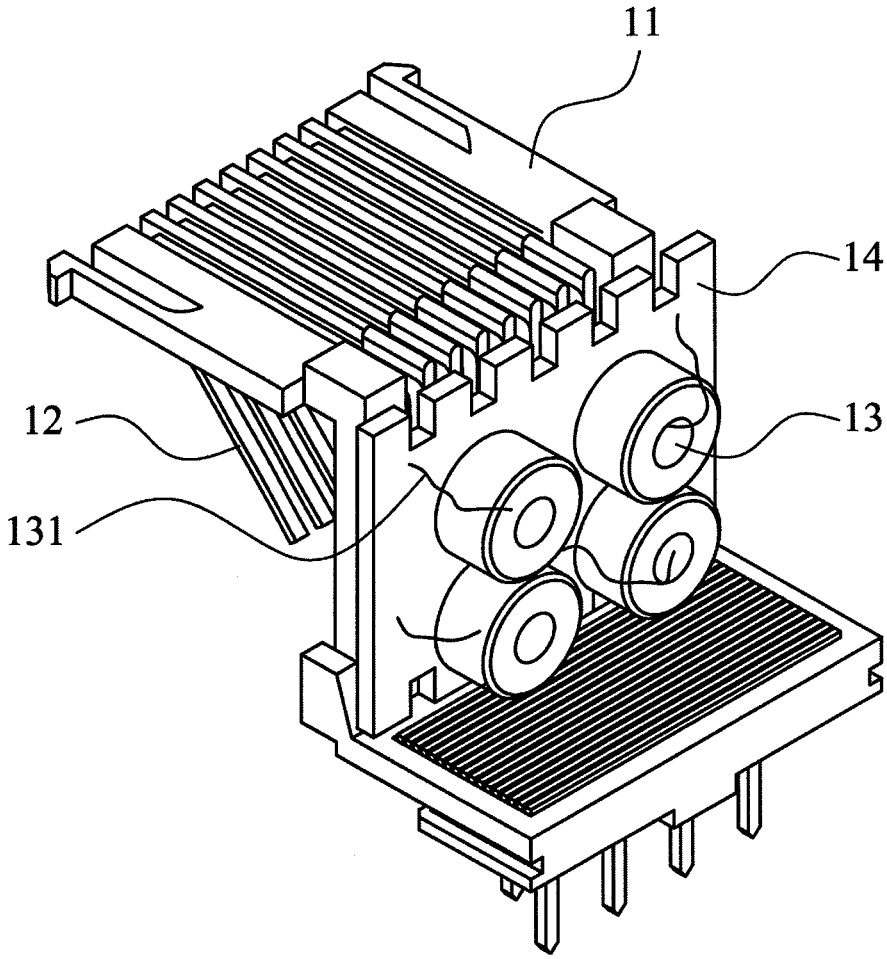
FIG. 1 ( PRIOR ART )
FIG. 1 is a perspective diagram of a conventional connector with filter circuits.

Referring to FIGS. 2 and 3A-3D, the connector includes a housing 25, a base 23, a circuit board 22, a receptacle I1, a plurality of first terminals 241, a plurality of second terminals 242, a filtering element 21, at least an indicator 27, a metal shield 26, and an insulator 28 according to an embodiment of the present invention. The base 23 is disposed in the housing 25. The receptacle I1 is formed in the housing 25 to receive an external plug. The filtering element 21 is disposed in an accommodating space between the circuit board 22 and the base 23 and is electrically connected to the circuit board 22.

Figure 3A:
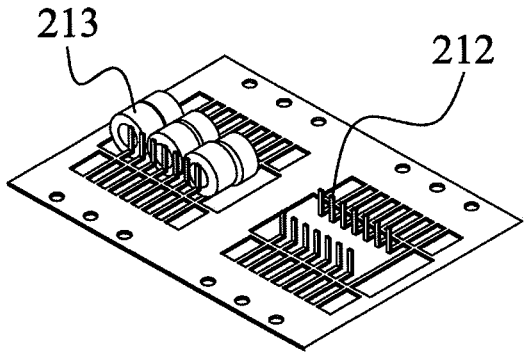
FIG. 3A is a perspective diagram showing a plurality of coils electrically connected to a plurality of leads according to an embodiment of the invention.
Figure 3B:
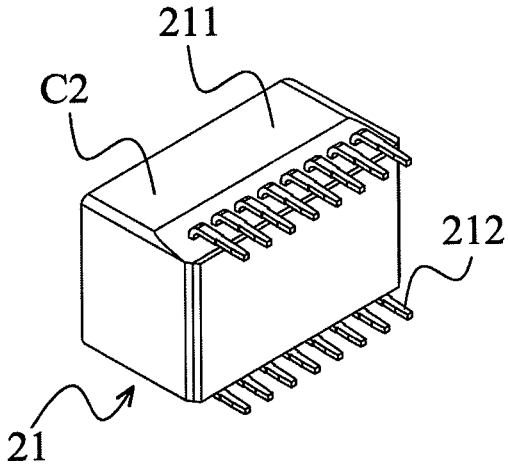
FIG. 3B is a perspective diagram of a filtering element according to an embodiment of the invention.
Figure 3C:
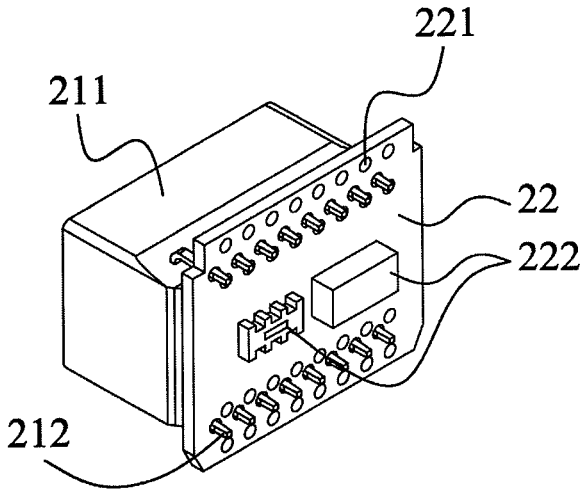
FIG. 3C is a perspective diagram of a filtering element connected to a circuit board according to an embodiment of the invention.
Figure 3D:
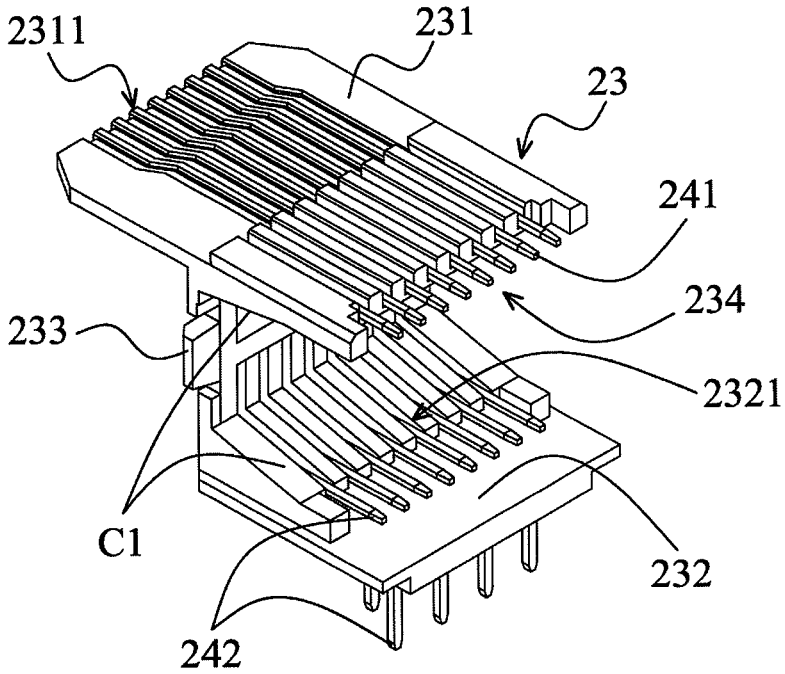
FIG. 3D is a perspective diagram showing a plurality of first and second terminals disposed on a base according to an embodiment of the invention.
Figure 3E:
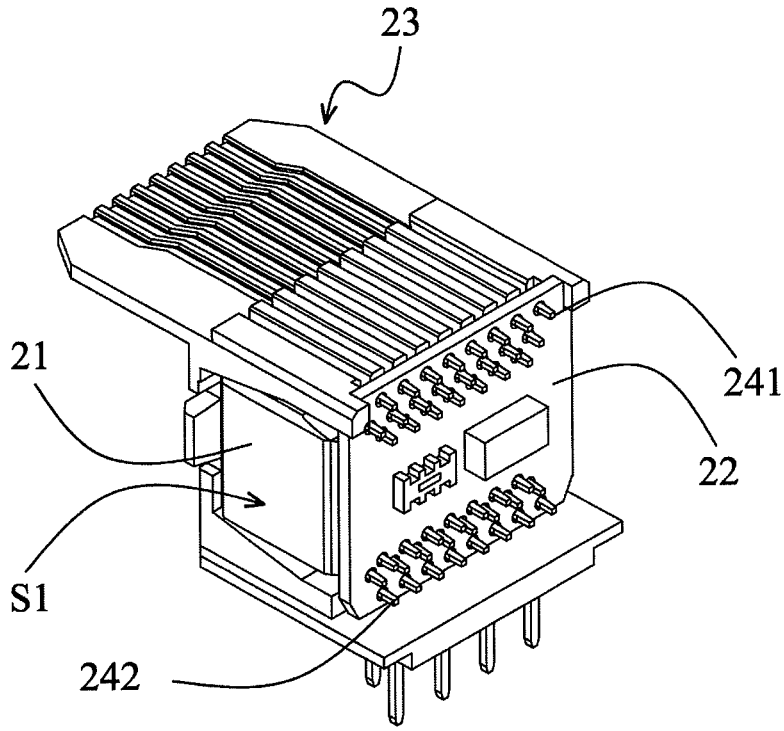
FIG. 3E is a perspective diagram of a filtering element received in an accommodating space of a base according to another embodiment of the invention.

The base 23 includes a first plate 231, a second plate 232, and a connection portion 233 connecting the first plate 231 with the second plate 232, as shown in FIG. 3D. In this embodiment, the first and second plates 231 and 232 are substantially parallel to each other and perpendicular to the connection portion 233. Specifically, the first plate 231 has a plurality of first slots 2311 for receiving the first terminals 241, and the second plate 232 has a plurality of second slots 2321 for receiving the second terminals 242. Referring to FIG. 3D, the first plate 231, the second plate 232, and the connection portion 233 of the base 23 define a recess 234. The circuit board 22 is disposed at a rear side of the base 23 and covers the recess 234 to form an accommodating space S1 to receive the filtering element 21 as shown in FIG. 3E. In FIGS. 3B, 3D and 3E, the inner surface of the recess 234 is configured to correspond to a main body 211 of the filtering element 21 (FIG. 3B). Referring to FIG. 3D, the recess 234 forms two slopes C1, respectively located between the first plate 231 and the connection portion 233 and between the second plate 232 and the connection portion 233, wherein the slopes C1 of the recess 234 corresponds to the slopes C2 of the main body 211 as shown in FIG. 3B. The first and second terminals 241 and 242 are fixed in the holes 221 of the circuit board 22 and are electrically connected to each other via the circuit board 22 as shown in FIG. 3C.

Figure 2:
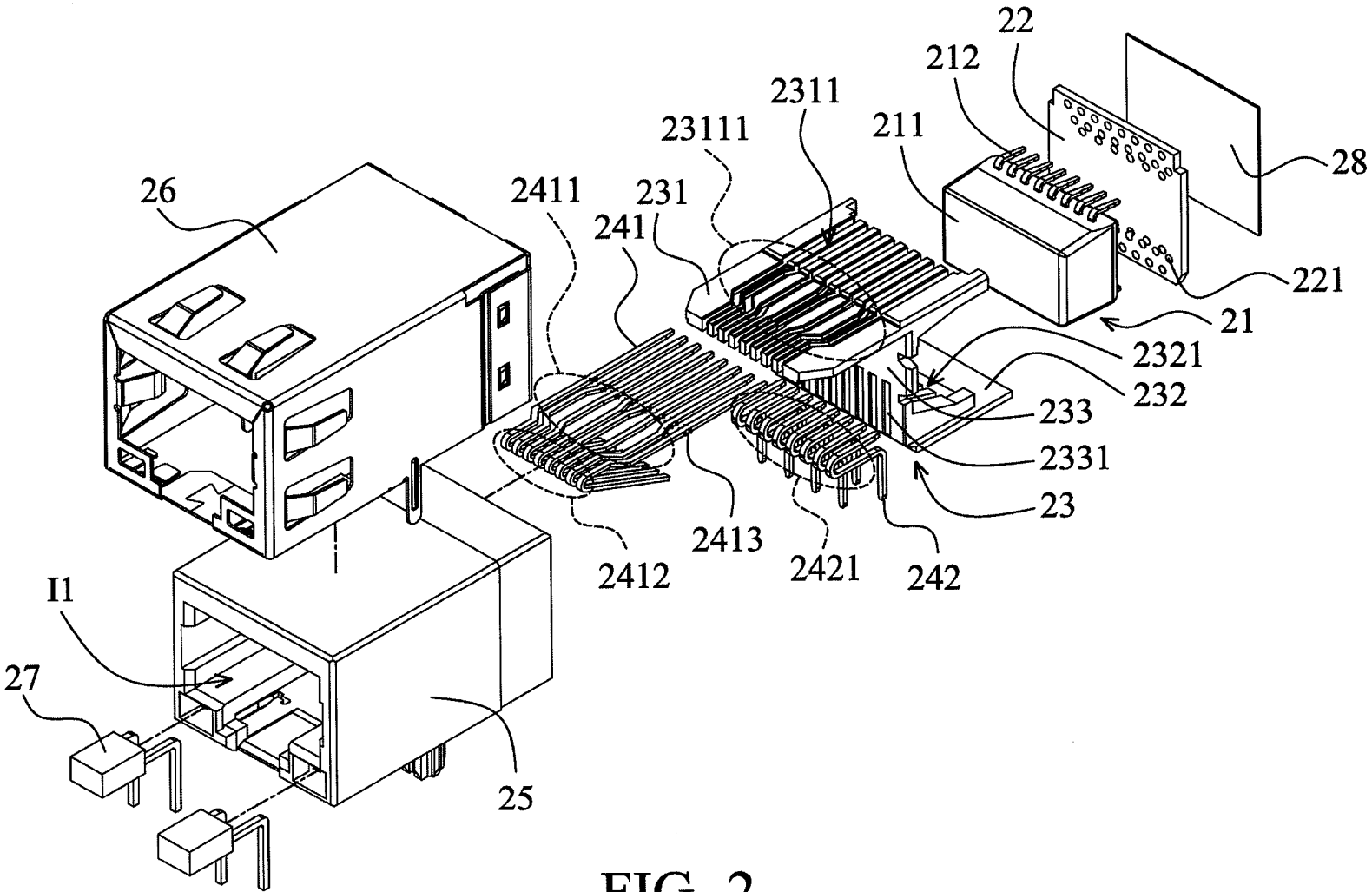
FIG. 2 is an exploded diagram of a connector according to an embodiment of the invention.

As shown in FIG. 2, the first terminals 241 are disposed on the base 23 and electrically connected to an external plug. The first terminal 241 has a deflecting portion 2411 deflected laterally and a bending portion 2412 bent downwardly. The first plate 231 forms a plurality of first slots 2311 corresponding to the first terminal 241. The first slot 2311 has a deflecting section 23111 for allowing the deflecting portion 2411 of the first terminal 241 to be engaged therein. Additionally, the first terminal 241 further has a nub 2413 to securely engage the first terminal 241 in the first slot 2311. In this embodiment, the first plate 231 is disposed on a top side of the receptacle I1. An end of the first terminal 241 is connected to the circuit board 22, and the other end of the first terminal 241 is bent downwardly to electrically connect with the external plug through the receptacle I1.

The second terminal 242 has a hook portion 2421 hooked onto the second plate 232 and connected to the circuit board 22 via an end thereof. During the assembling process, the hook portion 2421 is fixed in a hole 221 of the circuit board 22. The connection portion 233 has a plurality of slits 2331 corresponding to the second slots 2321. The hook portion 2421 of the second terminal 242 is extended through the slit 2331 during the assembling process to securely hook portion 2421 onto the second plate 232.

The indicator 27 is disposed on a bottom side of the housing 25, and the metal shield 26 encompasses the housing 25. The insulator 28 is disposed on a rear side of the circuit board 22 opposite to the filtering element 21, wherein the insulator 28 is located between the circuit board 22 and the metal shield 26. The connector can be an RJ11, RJ45, or USB connector, the filtering element can be a transformer, and the base 23 includes insulating material. In some embodiments, the base can be formed as a monolithic piece or assembled by several individual parts.

In this embodiment, the filtering element 21 includes a plurality of coils 213 electrically connected to a plurality of leads 212, as shown in FIGS. 3A and 3B. The leads 212 can be integrated with a lead frame, and the main body 211 of the filtering element 21 can be formed by injection molding with the coils 213 embedded therein. The leads 212 are fixed into the holes 221 of the circuit board 22, as shown in FIG. 3C, to connect the filtering element 21 with the circuit board 22.

Specifically, at least an electronic component 222 is disposed on a side of the circuit board 22, opposite to the filtering element 21.

Figure 4:
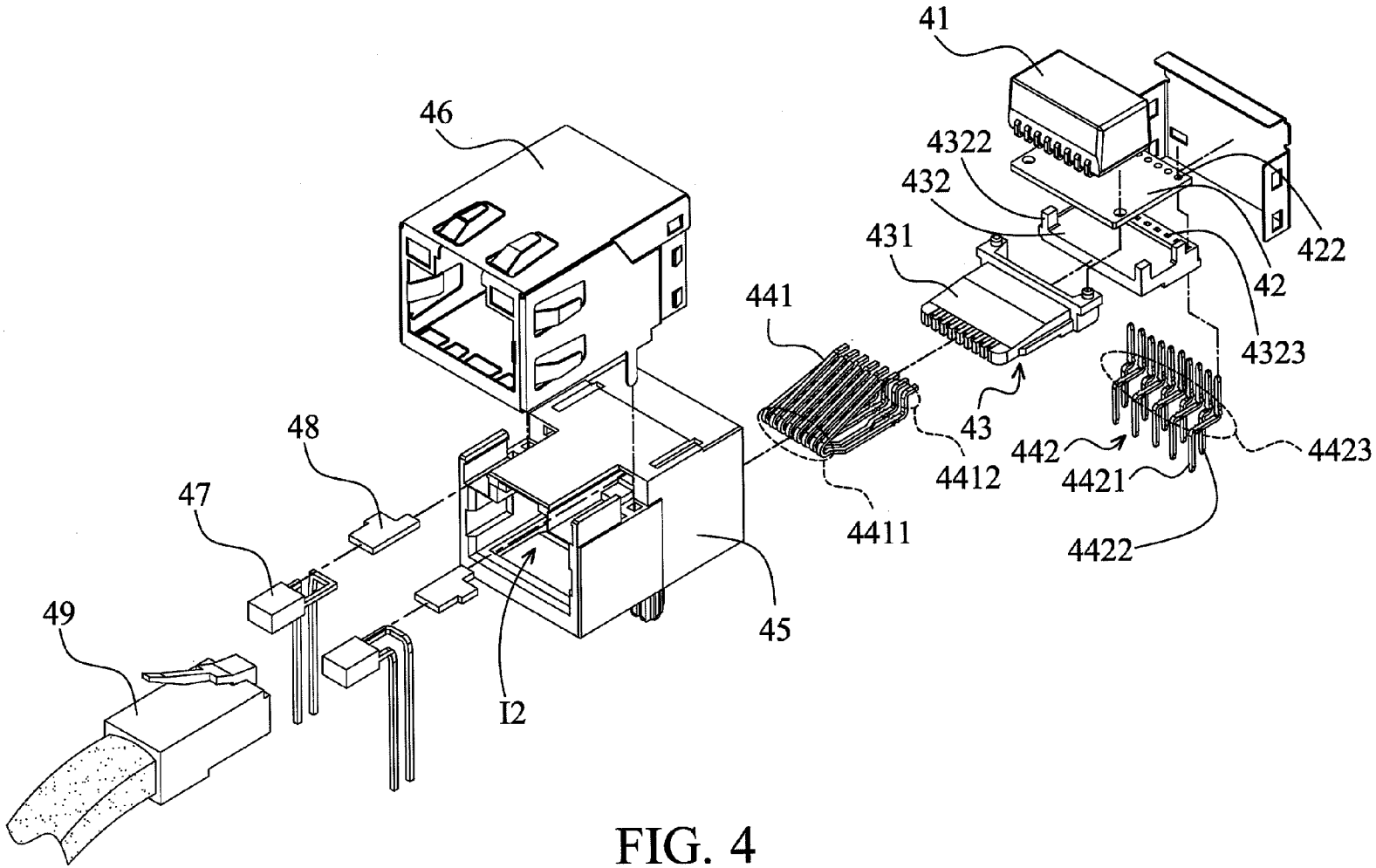
FIG. 4 is an exploded diagram of a connector according to another embodiment of the invention.

Referring to FIG. 4 showing another embodiment of the present invention, the connector includes a housing 45, a base 43, a circuit board 42, a receptacle 12, a plurality of first terminals 441, a plurality of second terminals 442, a filtering element 41, at least an indicator 47, and a metal shield 46. The base 43 is disposed in the housing 45 and includes a plurality of protrusions 4322. The circuit board 42 is disposed above the base 43 and contacts the protrusions 4322 of the base 43. As shown in FIG. 5D, a space S2 is formed between the base 43 and the circuit board 42. The receptacle 12 is formed on the housing 45 to receive an external plug 49. The first terminals 441 are disposed on the base 43 to electrically connect to the external plug 49 via the receptacle 12. The filtering element 41 is disposed on the circuit board 42 and is electrically connected to the circuit board 42. The indicator 47 is disposed on a top side of the housing 45. In this embodiment, at least a block 48 is provided to fix the indicator 47 to the housing 45, and the housing 45 is encompassed by the metal shield 46. In some embodiments, the base 23 includes insulating materials and can be formed as a monolithic piece or assembled by several individual parts.

Figure 5A:
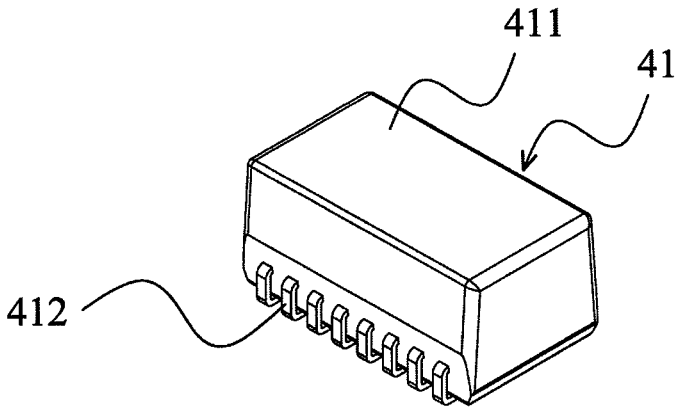
FIG. 5A is a perspective diagram of the filtering element in FIG. 4.
Figure 5B:
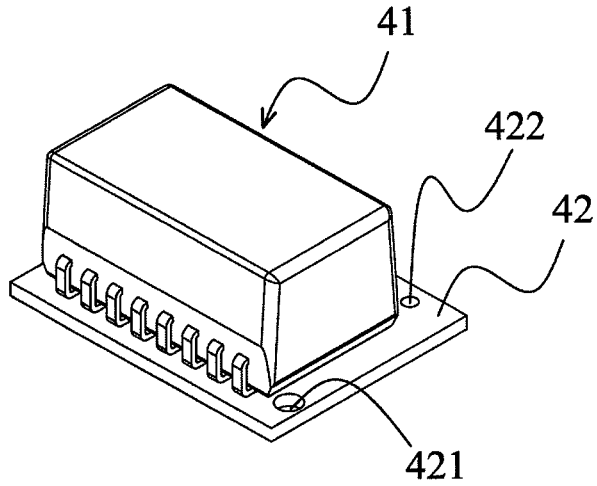
FIG. 5B is a perspective diagram of the filtering element of FIG. 5A connected to a circuit board according to an embodiment of the invention.
Figure 5C:
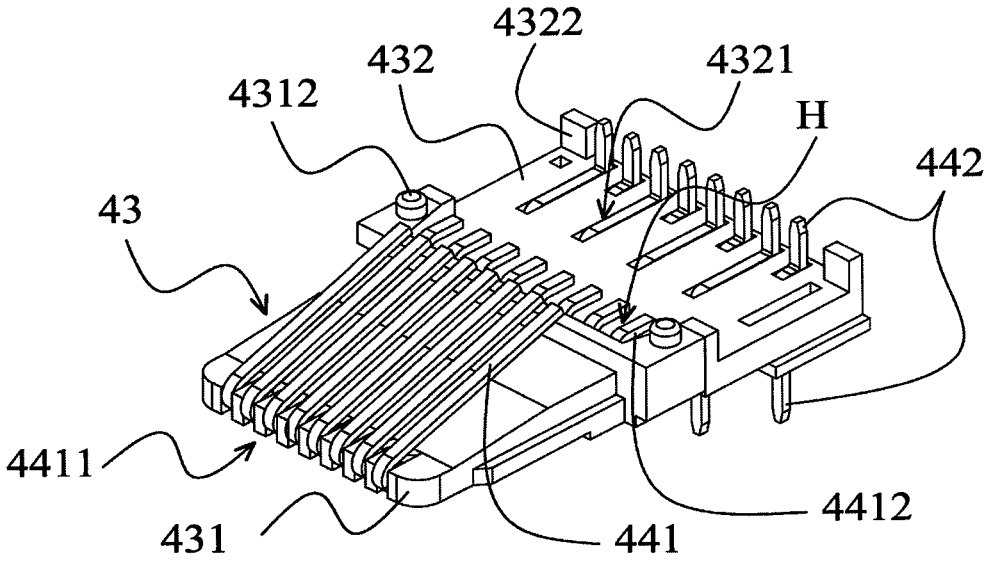
FIG. 5C is a perspective diagram showing a plurality of first and second terminals disposed on a base according to an embodiment of the invention.
Figure 5D:
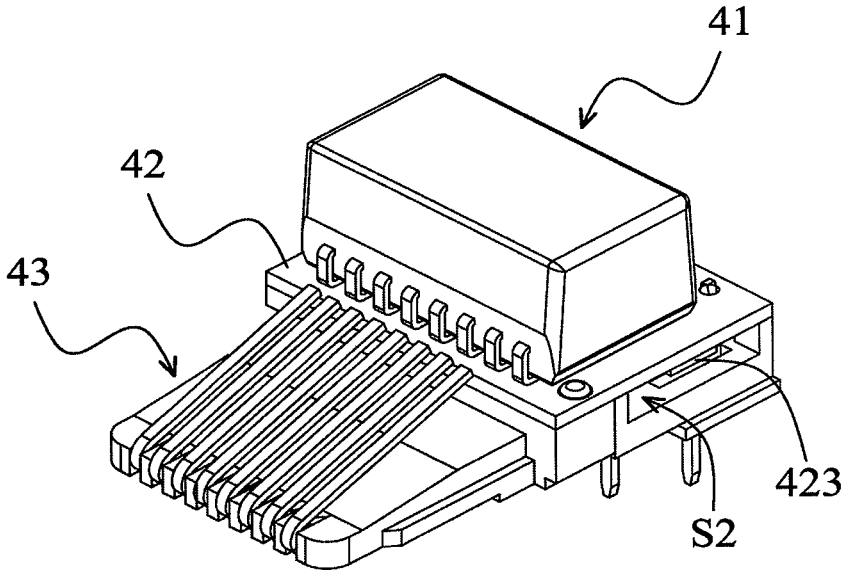
FIG. 5D is a perspective diagram of a filtering element connected to a base according to another embodiment of the invention.

The filtering element 41 includes a main body 411 and a plurality of leads 412, as shown in FIGS. 5A-5D. The base 43 includes a first plate 431 and a second plate 432, both of which are connected to each other in parallel. In this embodiment, the first plate 431 has a plurality of first slots 4311 for receiving the first terminals 441. The first terminal 441 has a first bending portion 4411 bent upwardly and oriented toward the receptacle 12 to electrically connect to the external plug 49 via the receptacle 12. Additionally, the first terminal 441 further has a second bending portion 4412, and the first and second plates 431 and 432 form at least a through hole H, as shown in FIG. 5C. The second bending portion 4412 is bent upwardly from the bottom to the upper surface of the first plate 431 and extended through the through hole H; whereby an end of the second bending portion 4412 protrudes upon the second plate 432 and electrically connects to the circuit board 42. In this embodiment, the first and second terminals 441 and 442 are electrically connected via the circuit board 42. As shown in FIG. 4, the second terminals 442 are disposed through the base 43 and have a transition portion 4423. Specifically, the second terminals 442 include a plurality of first and second leads 4421 and 4422, wherein the transition portions 4423 of the second leads 4422 are shorter than those of the first leads 4421. Referring to FIG. 5C, the base 43 includes a plurality of second slots 4321 for receiving the transition portions 4423 of the second terminals 442. The base 43 further includes a plurality of openings 4323 corresponding to the holes 422 of the circuit board 42 as shown in FIG. 4. The second terminals 442 pass through the openings 4323 of the base 43 and are fixed in the holes 422 of the circuit board 42.

The connector further includes an electronic component 423 disposed on a side of the circuit board 42, opposite to the filtering element 41 and located in the space S2 between the circuit board 42 and the base 43, as shown in FIG. 5D. Furthermore, the base 43 includes at least a positioning member 4312, and the circuit board has at least a positioning hole 421 corresponding to the positioning member 4312.

The present application provides a connector, such as an RJ11, RJ45 or USB connector, including a filtering element with a plurality of coils embedded in a main body by injection molding. The leads of the coils are connected to a circuit board so as to prevent breaking or shortages of the enameled wires during the soldering process. The assembling process and time of the connector of the present invention is respectively simplified and shortened.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A connector comprising:

a housing;

a base disposed in the housing and having a recess;

a circuit board disposed at a rear side of the base to cover the recess for forming an accommodating space;

a receptacle formed in the housing to receive an external plug;

a plurality of first terminals oriented toward the external plug and directly connecting the base with the external plug;

a filtering element disposed in the accommodating space and electrically connected to the circuit board;

an insulator disposed at one side of the circuit board, opposite to the filtering element; and an electronic component disposed on the circuit board and located between the insulator and the circuit board.

2. The connector as claimed in claim 1, wherein the base comprises a first plate, a second plate, and a connection portion connecting the first plate with the second plate, wherein the first and second plates are substantially parallel to each other and perpendicular to the connection portion.

3. The connector as claimed in claim 1, further comprising a plurality of second terminals electrically connected to the first terminals via the circuit board.

4. The connector as claimed in claim 1, wherein the filtering element is a transformer, and the connector is an RJ11, RJ45 or USB connector.

5. The connector as claimed in claim 1, further comprising an indicator and a metal shield, wherein the indicator is disposed on the housing, and the metal shield covers the housing.

6. The connector as claimed in claim 1, wherein the base is substantially made of insulating material.

7. The connector as claimed in claim 1, wherein the base is formed as a monolithic piece or assembled by individual parts.

8. The connector as claimed in claim 2, wherein the first plate has a plurality of first slots for receiving the first terminals.

9. The connector as claimed in claim 8, wherein the first terminal has a deflecting portion and a bending portion, the deflecting portion is deflected laterally, the bending portion is bent downwardly, the first slot has a deflecting section for allowing the deflecting portion of the first terminal to be engaged therein, and the first terminal has a nub to engage the first terminal in the first slot.

10. The connector as claimed in claim 2, wherein the first plate is disposed above the receptacle, an end of the first terminal is connected to the circuit board, and the other end of the first terminal is bent downwardly to electrically connect to the external plug via the receptacle.

11. The connector as claimed in claim 2, wherein the recess is formed by the first plate, the second plate, and the connection portion, and the recess forms two slopes respectively located between the first plate and the connection portion and between the second plate and the connection portion.

12. The connector as claimed in claim 3, wherein the base comprises a plurality of second slots for receiving the second terminals.

13. The connector as claimed in claim 1, wherein the filtering element comprises a main body and a plurality of leads connected to the circuit board.

14. The connector as claimed in claim 13, wherein an inner surface of the recess is configured to correspond to a shape of the main body of the filtering element.

15. The connector as claimed in claim 12, wherein the connection portion has a plurality of slits disposed corresponding to the second slots.

16. The connector as claimed in claim 13, wherein the circuit board comprises a plurality of holes for fixing the leads of the filtering element or the first terminals.

17. A connector comprising:

a housing;

a base disposed in the housing and having a recess;

a circuit board disposed at a rear side of the base to cover the recess for forming an accommodating space;

a receptacle formed in the housing to receive an external plug;

a plurality of first terminals disposed on the base to electrically connect with the external plug;

a filtering element disposed in the accommodating space and electrically connected to the circuit board; and a plurality of second terminals electrically connected to the first terminals via the circuit board;

wherein the second terminal has a hook portion, the hook portion is hooked onto the second plate and connected to the circuit board, and the circuit board comprises a plurality of holes for allowing ends of the hook portions to be fixed therein.

18. A connector comprising:

a housing;

a base disposed in the housing and having a recess;

a circuit board disposed at a rear side of the base to cover the recess for forming an accommodating space;

a receptacle formed in the housing to receive an external plug;

a plurality of first terminals disposed on the base to electrically connect with the external plug; and a filtering element disposed in the accommodating space and electrically connected to the circuit board, wherein the filtering element comprises a main body and a plurality of leads connected to the circuit board, and the main body comprises a plurality of coils electrically connected to the leads, the main body is formed by injection molding with the coils embedded therein, and the leads are integrated with a lead frame.

* * * * *